US011717469B2

(12) United States Patent
Hu

(10) Patent No.: US 11,717,469 B2
(45) Date of Patent: Aug. 8, 2023

(54) ANTI-VIBRATION AND WEAR-RESISTANT MASSAGE GUN

(71) Applicant: Dongguan Qinghuo Technology Co., Ltd., Dongguan (CN)

(72) Inventor: Dashuai Hu, Dongguan (CN)

( * ) Notice: Subject to any disclaimer, the term of this patent is extended or adjusted under 35 U.S.C. 154(b) by 295 days.

(21) Appl. No.: 17/213,037

(22) Filed: Mar. 25, 2021

(65) Prior Publication Data

US 2022/0151865 A1 May 19, 2022

(30) Foreign Application Priority Data

Nov. 18, 2020 (CN) ..... 202011292748.5
Jan. 7, 2021 (CN) ..... 202110015615.1

(51) Int. Cl.
*A61H 23/00* (2006.01)

(52) U.S. Cl.
CPC ... *A61H 23/006* (2013.01); *A61H 2201/0153* (2013.01); *A61H 2201/1654* (2013.01); *A61H 2201/1669* (2013.01)

(58) Field of Classification Search
CPC ..... A61H 23/00–06; A61H 2201/0165–0169; A61H 1/006; A61H 1/008; A61H 2023/002–045
USPC ..... 601/107
See application file for complete search history.

(56) References Cited

U.S. PATENT DOCUMENTS 10,993,874 B1 * 5/2021 Marton ..... A61H 23/006
2009/0099413 A1 * 4/2009 Kobashikawa ..... A61H 19/44 600/38
2021/0038472 A1 * 2/2021 Marton ..... A61H 23/0263
2021/0113427 A1 * 4/2021 Liu ..... A61H 23/0254
2021/0196562 A1 * 7/2021 Zhao ..... A61H 23/006
2022/0211572 A1 * 7/2022 Cao ..... A61H 23/006

FOREIGN PATENT DOCUMENTS

CN 103189021 A * 7/2013 ..... A61B 17/54
CN 110302050 A * 10/2019 ..... A61H 23/008
CN 110680711 A * 1/2020
CN 111092516 A * 5/2020 ..... A61H 23/02
JP 5108705 B2 * 12/2012
WO WO-2019014031 A1 * 1/2019 ..... A61H 1/00

OTHER PUBLICATIONS

Translation of JP-5108705-B2 (Year: 2012).*
Translation of CN-110680711-A (Year: 2020).*
Translation of CN-103189021-A (Year: 2013).*
Translation of CN-111092516-A (Year: 2020).*
Translation of CN-110302050-A (Year: 2019).*

* cited by examiner

*Primary Examiner* — Valerie L Woodward
*Assistant Examiner* — Paige Kathleen Bugg
(74) *Attorney, Agent, or Firm* — Tsz Lung Yeung

(57) ABSTRACT

The present invention relates to an anti-vibration and wear-resistant massage gun, which comprises an adaptive buffer damping sleeve (300), wherein the damping sleeve (300) is provided with a plurality of convex ribs (310), the damping sleeve (300) is set up in an assembly cavity (31) through the convex ribs (310), and a self-adjusting clearance cavity (400) is formed between the damping sleeve (300) and the assembly cavity (31), and the anti-vibration and wear-resistant massage gun further comprises a friction protection body (100), wherein the friction protection body (100) is covered on a moving shaft (10) to improve the abrasion resistance of the massage gun.

21 Claims, 15 Drawing Sheets

ANTI-VIBRATION AND WEAR-RESISTANT MASSAGE GUN

BACKGROUND OF THE PRESENT INVENTION

Field of Invention

The present invention relates to a massage gun, and more particularly to a massage gun with an anti-vibration and wear-resistant structure.

Description of Related Arts

As we all know, all kinds of massage equipment have been universally used by people and the principle of various massage equipment is roughly to relax the human muscles by repeatedly hitting the human body.

At present, massage guns are most commonly used among various massage equipment, as shown in FIG. 1, the traditional massage gun generally comprises a gun body (1) and a massage head (2), when being used, the massage head (2) is assembled on the front end of the gun body (1), and the gun body (1) drives the massage head (2) to reciprocate back and forth to achieve the effect of repeatedly hitting the human body to relax the muscles in a specific position of the human body.

In order to improve the using feeling and product quality of the traditional massage gun, it mainly needs to solve two technical problems. The first technical problem is: how to reduce the vibration generated by the massage head (2) during movement, thereby reducing the noise. The second technical problem is: how to solve the problem of structural wear when the massage head (2) moves.

The first technical problem is described in detail, as shown in FIG. 1. In order to reduce the vibration caused by the movement of the massage head (2), it is necessary to provide a flexible damping sleeve (7) between the shaft sleeve (6) and the gun body (1).

As shown in FIG. 1, the flexible damping sleeves (7) of traditional massage guns are all round-tube shaped, which have a smooth inner surface and a smooth outer surface, wherein the flexible damping sleeve (7) is sleeved on the shaft sleeve (6), and they define a first surface contact position (S1), wherein the flexible damping sleeve (7) is assembled in the gun body (1), and they define a second surface contact position (S2). In practice, matching through the above mentioned surface contact has the disadvantage that the fit clearance is not easy to control.

As shown in FIG. 2, when the fit clearance is too large, the shaft sleeve (6) and other moving members often shake in the gun body (1), which will cause vibration, and increase working noise.

As shown in FIG. 3, when the fit clearance is too small, the flexible damping sleeve (7) will inevitably be squeezed and deformed during the assembly process, which resulting in squeezing clearances and excessive squeezing positions, and then shaft sleeve (6) and other moving members deviate from the axis of the gun body (1), which affects the stability of the working.

The second technical problem is described in detail, as shown in FIGS. 1, 4 and 5. In order to enable the massage head (2) to perform high-speed forward and backward reciprocating motion, the gun body (1) is provided with a motor (3), a connecting rod (4), a moving shaft (5) and the shaft sleeve (6), wherein the shaft sleeve (6) is disposed in the gun body (1), the moving shaft (5) is disposed in the shaft sleeve (6), and the connecting rod (4) is connected between the output shaft of the motor (3) and the moving shaft (5).

When working, the massage head (2) is inserted in the front end of the moving shaft (5), the motor (3) works and drives the moving shaft (5) through the connecting rod (4) to perform high-speed forward and backward reciprocating motion in the shaft sleeve (6), at this moment, the moving shaft (5) drives the massage head (2) to perform beating massage actions.

In order to support the moving shaft (5) to perform high-speed reciprocating motion in the shaft sleeve (6), the traditional massage gun generally applies the following technical design schemes.

Scheme one: the moving shaft (5) is made of aluminum or other metal materials, the shaft sleeve (6) is made of resin or other non-metal materials, and the core design purpose of the scheme one is: the material hardness of the shaft sleeve (6) is lower than the material hardness of the moving shaft (5).

The design significance of the scheme one is that since the material hardness of the shaft sleeve (6) is lower than the material hardness of the moving shaft (5), the moving shaft (5) will not be worn during the high-speed movement.

However, the using disadvantage of the scheme one is that after the product works for a long time and generates heat, the thermal expansion rate of the moving shaft (5) is significantly higher than the thermal expansion rate of the shaft sleeve (6), so it is bound to happen that the moving shaft (5) is stuck in the shaft sleeve (6).

Scheme two: in order to overcome the disadvantage of the scheme one, the designers develop the scheme two. In the scheme two, the moving shaft (5) is made of aluminum or other metal materials, the shaft sleeve (6) is made of copper or other metal materials. The core design purpose of the scheme two is: to avoid the occurrence of the situation that the moving shaft (5) is stuck in the shaft sleeve (6), because the thermal expansion rate of the moving shaft (5) is significantly higher than the thermal expansion rate of the shaft sleeve (6).

The design significance of the scheme two is that the moving shaft (5) and the shaft sleeve (6) are made of metal materials. At the same time, the material hardness of the shaft sleeve (6) is higher than or equal to the material hardness of the moving shaft (5), so that the moving shaft (5) and the shaft sleeve (6) have the same or similar thermal expansion rate, thereby avoiding the situation that the moving shaft (5) is stuck in the shaft sleeve (6).

However, the using disadvantage of the scheme two is that since the material hardness of the shaft sleeve (6) is higher than or equal to the material hardness of the moving shaft (5), the moving shaft (5) will inevitably be worn after a long period of work, which increases the clearance between the moving shaft (5) and the shaft sleeve (6), thereby affecting the stability of the product, and greatly increasing the working noise of the product.

In addition, as shown in FIGS. 4 and 5, in the traditional massage guns, the massage heads (2) are all directly inserted into the moving shafts (5). This plugging-unplugging method requires a more precise matching relationship between the massage head (2) and the moving shaft (5).

When the fit clearance between the massage head (2) and the moving shaft (5) is too large, although it can be convenient for the user to plug and unplug, but the too large fit clearance often causes the massage head (2) to tilt when it is working.

When the fit clearance between the massage head (2) and the moving shaft (5) is too small, although the massage head (2) can be stably and safely inserted into the moving shaft (5), the users need to spend a lot of effort to pull out the massage head (2) for replacement, thereby greatly reduces the using feeling thereof.

As shown in FIGS. 4 and 5, if employing the method of slotting in the moving shaft (5) to mate with the massage head (2) (such as: making track slots, etc.), which will inevitably reduce the wall thickness (H) of the moving shaft (5), thereby greatly reducing the structural strength of the moving shaft (5).

The above is the main technical problems of the traditional massage guns.

SUMMARY OF THE PRESENT INVENTION

The technical solution adopted by the present invention is: an anti-vibration and wear-resistant massage gun, which comprises an adaptive buffer damping sleeve (300), wherein the damping sleeve (300) is disposed between a shaft sleeve (20) and a massage gun body (30), and the damping sleeve (300) is used for alleviating the vibration generated by the shaft sleeve (20), so that the vibration of the shaft sleeve (20) will not be directly transmitted to the massage gun body (30), wherein the massage gun body (30) is provided with an assembly cavity (31), the damping sleeve (300) is sleeved on the outer surface of the shaft sleeve (20), and at the same time, the damping sleeve (300) is assembled in the assembly cavity (31), the damping sleeve (300) is provided with several convex ribs (310), the several convex ribs (310) are located between the damping sleeve (300) and the assembly cavity (31), the damping sleeve (300) is set up in the assembly cavity (31) through the several convex ribs (310), and a self-adjusting clearance cavity (400) is formed between the damping sleeve (300) and the assembly cavity (31).

An anti-vibration and wear-resistant massage gun, which comprises a moving shaft (10), a shaft sleeve (20) and a friction protection body (100), wherein the shaft sleeve (20) is fixedly disposed in a massage gun body (30), the moving shaft (10) is disposed in the shaft sleeve (20), the moving shaft (10) is capable of reciprocating back and forth in the shaft sleeve (20), a massage head (40) is detachably disposed on the front end of the moving shaft (10), the friction protection body (100) is covered on the moving shaft (10), and at the same time, the friction protection body (100) is located between the moving shaft (10) and the shaft sleeve (20), and when the moving shaft (10) reciprocates back and forth in the shaft sleeve (20), the friction protection body (100) moves synchronously with the moving shaft (10), at this time, frictional force is generated between the friction protection body (100) and the shaft sleeve (20), the moving shaft (10) is not in contact with the shaft sleeve (20), the material hardness of the friction protection body (100) is greater than the material hardness of the shaft sleeve (20), the material hardness of the shaft sleeve (20) is greater than the material hardness of the moving shaft (10), the tube wall thickness (H1) of the friction protection body (100) is smaller than the tube wall thickness (H2) of the shaft sleeve (20), the tube wall thickness (H1) of the friction protection body (100) is smaller than the tube wall thickness (H3) of the moving shaft (10).

The beneficial effects of the present invention are:

The present invention provides an anti-vibration and wear-resistant massage gun, which comprises an adaptive buffer damping sleeve, wherein the damping sleeve is provided with several convex ribs, the present invention is capable of forming a self-adjusting clearance cavity through the structures of several the convex ribs, thereby creating an assembly margin and a vibration adjustment margin, so that the central axis of the shaft sleeve and the central axis of the assembly cavity coincide as much as possible, thereby ensuring the stability of the product during operation, and reducing the working noise.

The present invention provides an anti-vibration and wear-resistant massage gun, which adopts the friction protection body with thin tube wall and hard material, which can firstly avoid the wear of the moving shaft, and secondly, can reduce the thermal expansion and contraction value of the friction protection body, to avoid the occurrence of the situation that the moving shaft gets stuck in the shaft sleeve after thermal expansion.

The present invention provides an anti-vibration and wear-resistant massage gun, wherein since the existence of the friction protection body in the structure, and at the same time, since the hardness and structural strength of the friction protection body are higher than the moving shaft, making assembly groove will not reduce the structural strength of the portion of the moving shaft, and the massage head is able to coincide with the axis of the moving shaft through a assembly mechanism and the structure of the assembly groove, thereby improving the assembly accuracy, and facilitating disassembly.

DETAILED DESCRIPTION OF THE PREFERRED EMBODIMENT

As shown in FIGS. 6 to 9, an anti-vibration and wear-resistant massage gun comprises an adaptive buffer damping sleeve (300).

Figure 1:
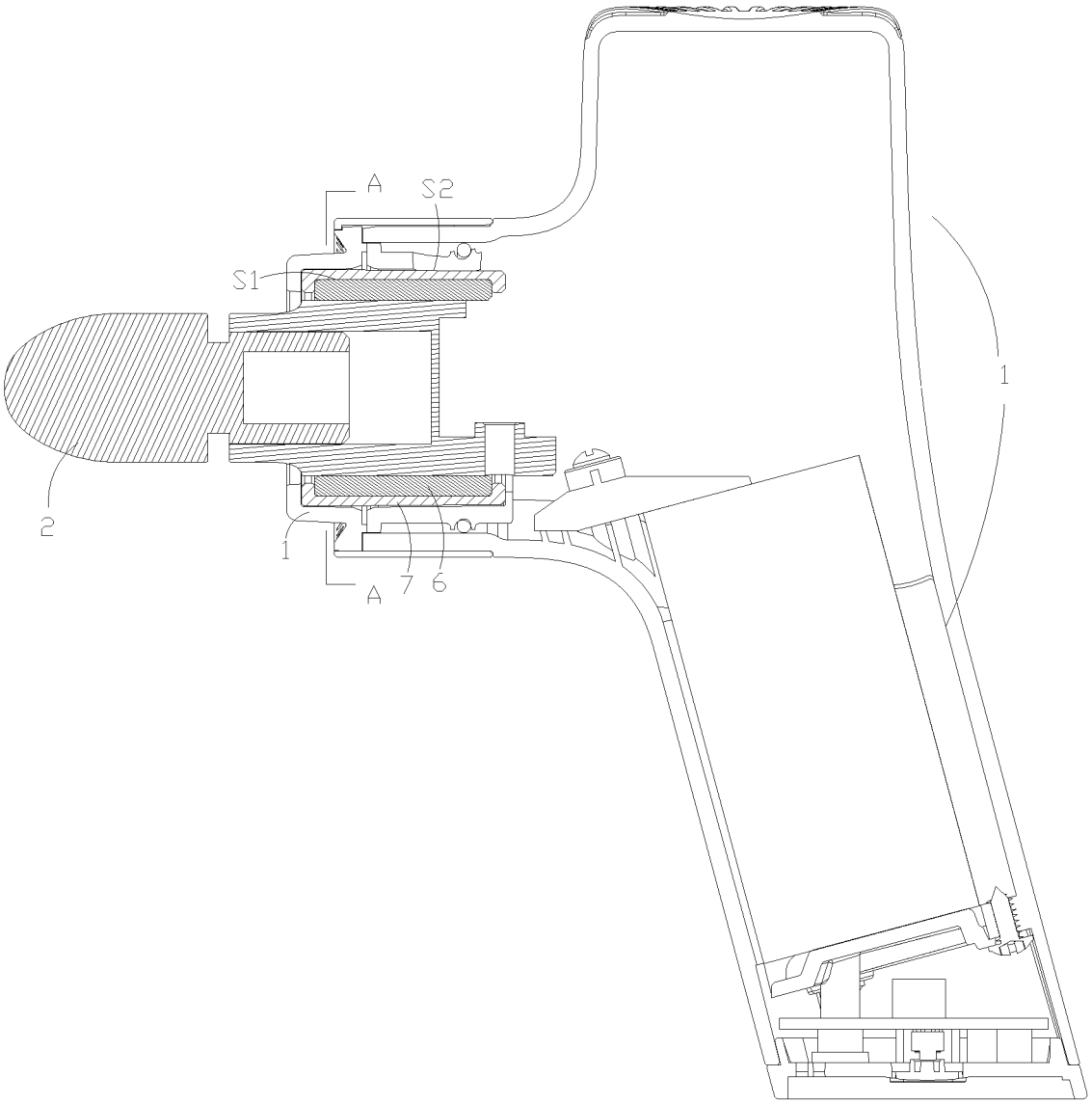
FIG. 1 is a structural diagram of the structure of a traditional massage gun.
Figure 2:
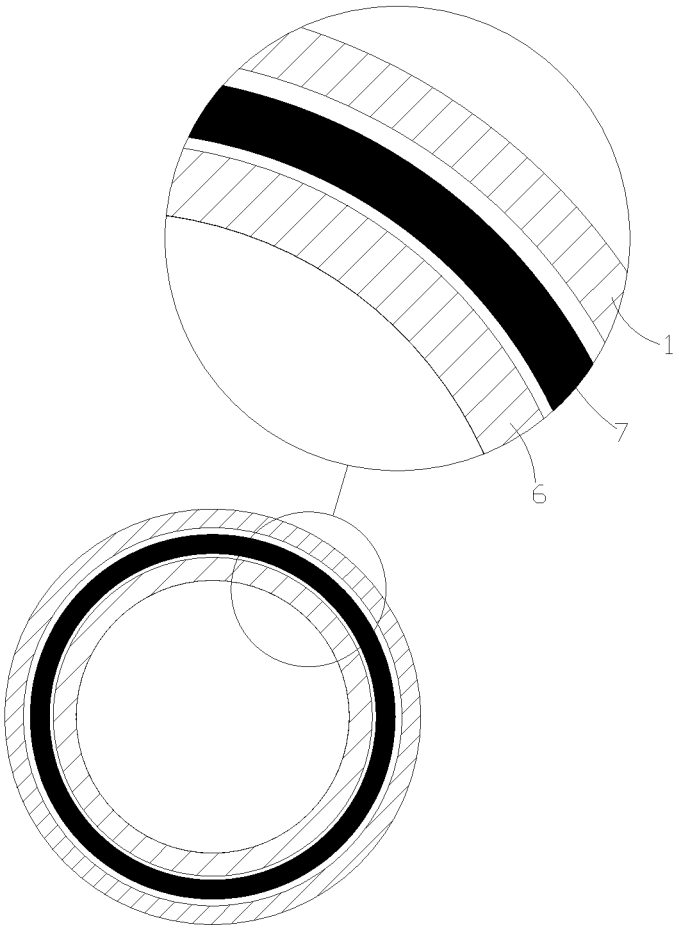
FIG. 2 is a sectional diagram view of the excessively large fit clearance in the direction A-A of the traditional massage gun shown in FIG. 1.
Figure 3:
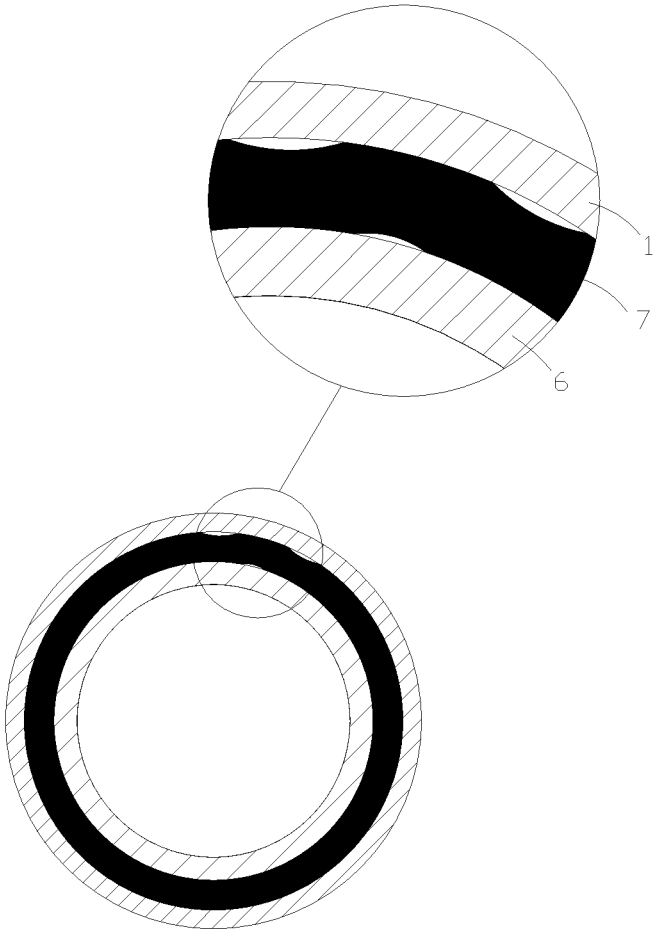
FIG. 3 is a sectional diagram view of the excessively small fit clearance in the direction A-A of the traditional massage gun shown in FIG. 1.
Figure 4:
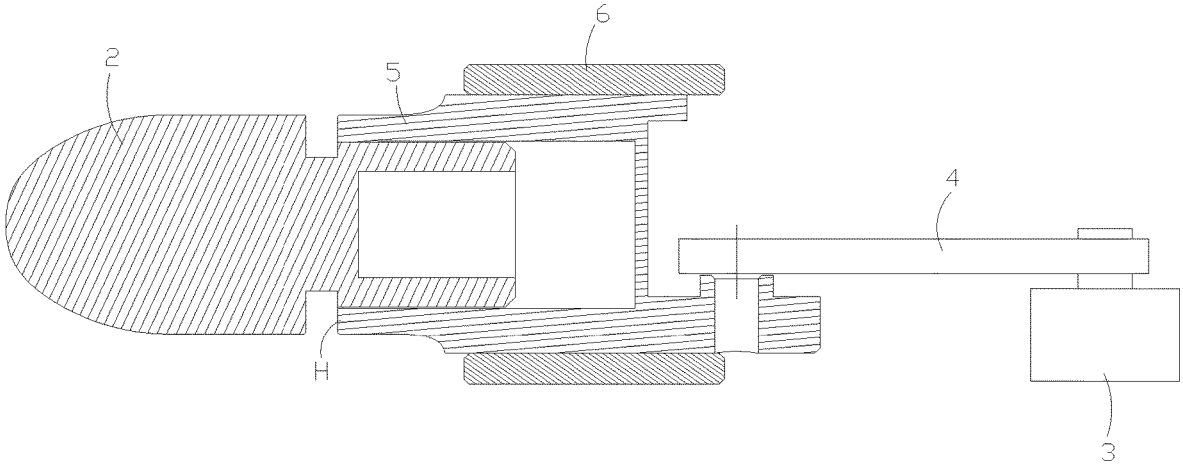
FIG. 4 is a structural diagram of the moving shaft and the shaft sleeve of the traditional massage gun.
Figure 5:
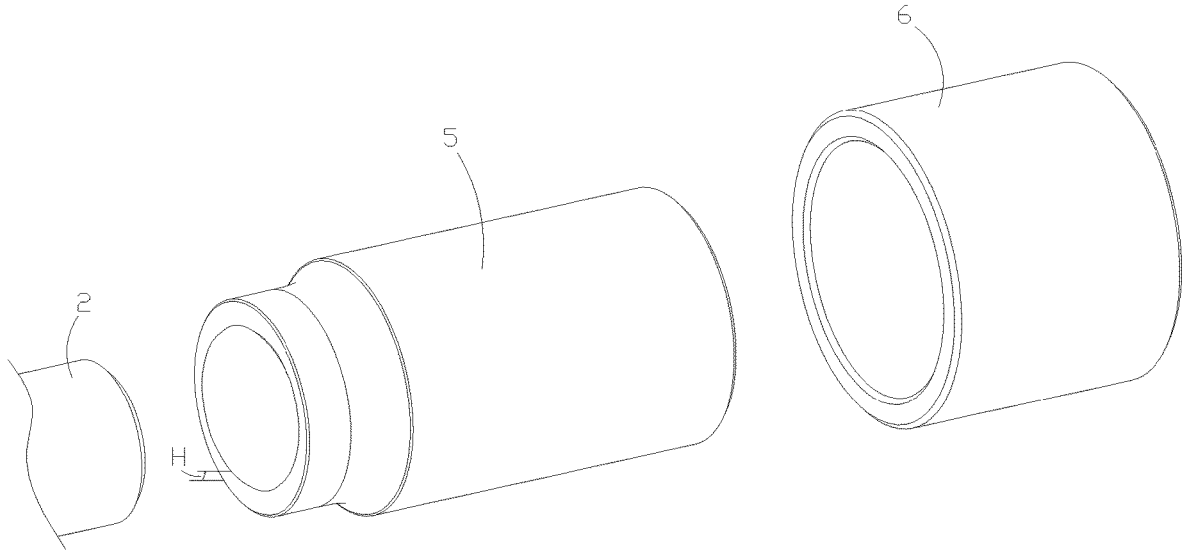
FIG. 5 is a perspective diagram of the moving shaft and the shaft sleeve of the traditional massage gun.
Figure 6:
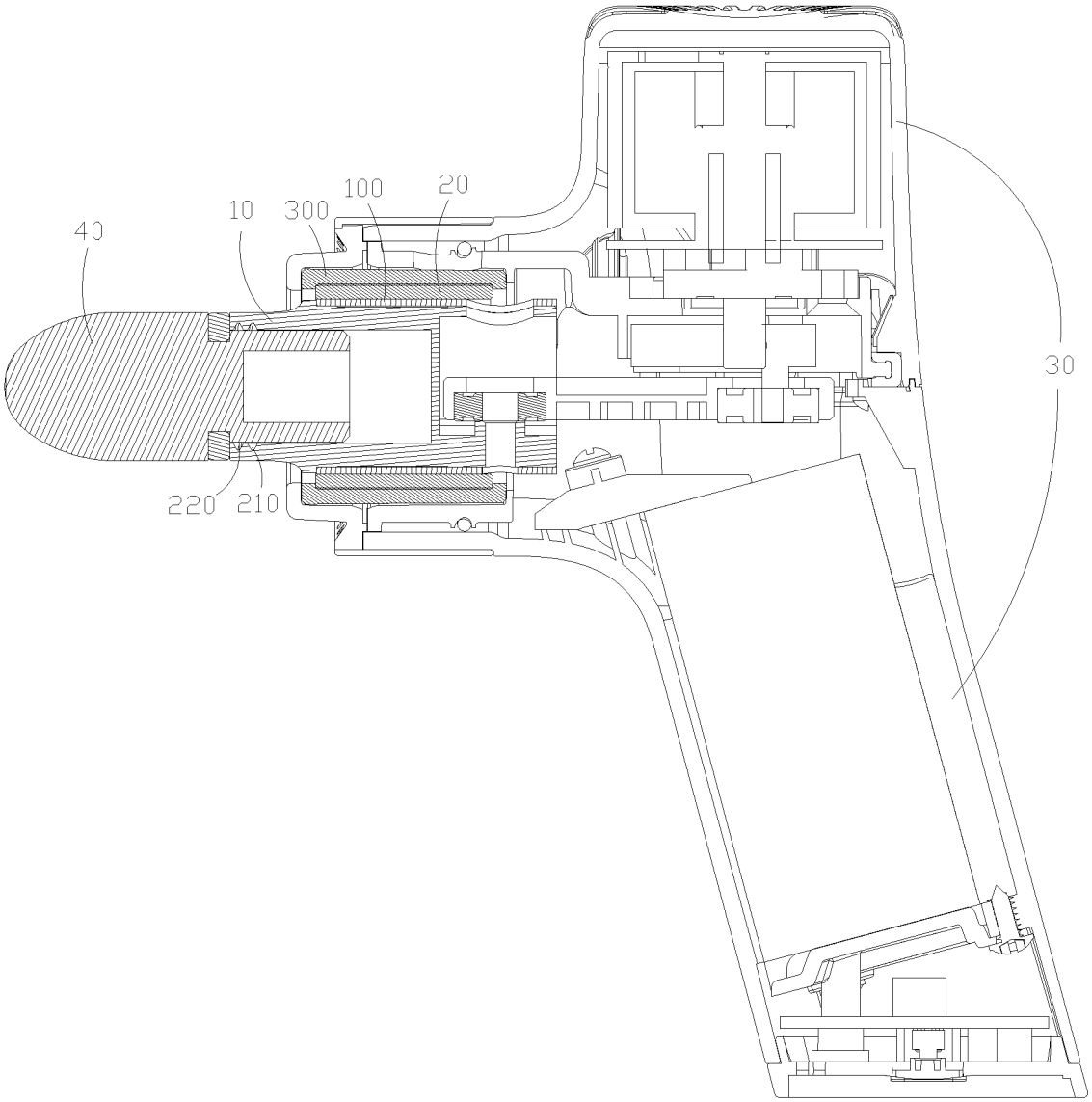
FIG. 6 is a sectional diagram of the present invention.

As shown in FIG. 6, the damping sleeve (300) is disposed between a shaft sleeve (20) and a massage gun body (30), and the damping sleeve (300) is used for alleviating the vibration generated by the shaft sleeve (20) to make the vibration of the shaft sleeve (20) not be directly transmitted to the massage gun body (30).

Specifically, when a moving shaft (10) moves in the shaft sleeve (20), it will inevitably cause the shaft sleeve (20) to vibrate, and the damping sleeve (300) is capable of alleviating the vibration generated by the shaft sleeve (20), to improve the using feeling thereof.

The damping sleeve (300) is made of flexible damping material, such as silica gel, soft plastic, etc.

Figure 7:
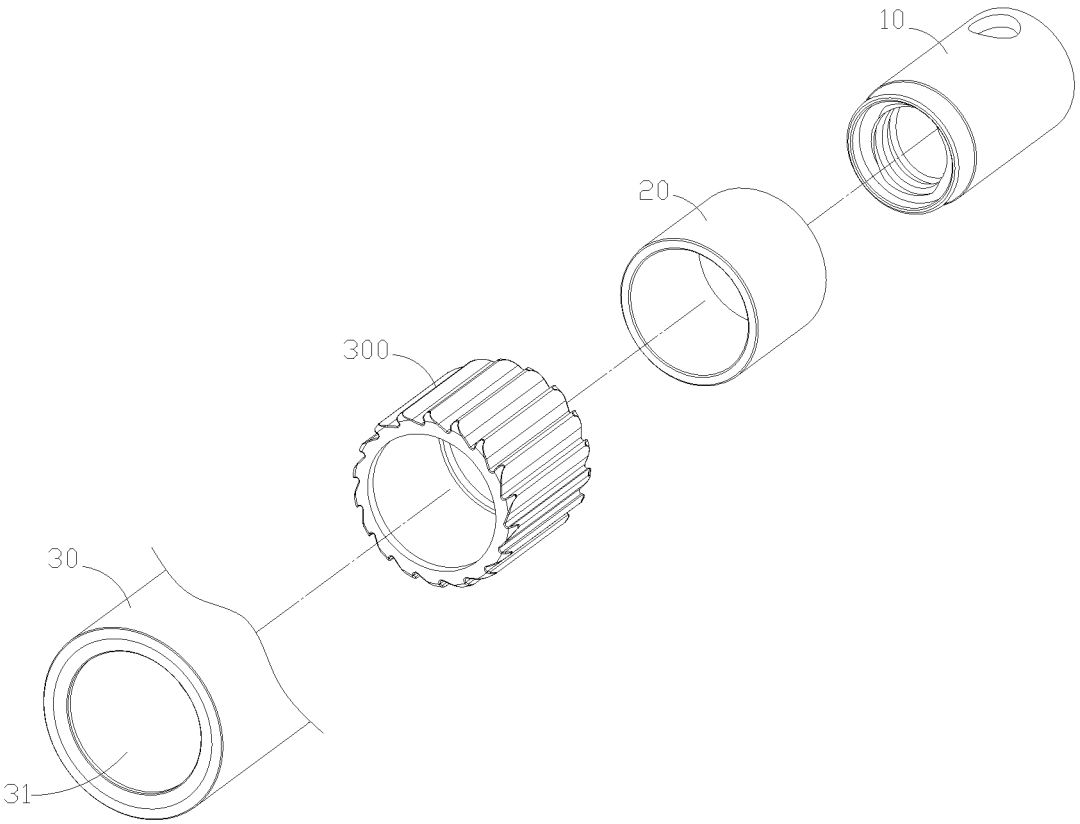
FIG. 7 is an exploded view of the damping sleeve, the shaft sleeve and the moving shaft of the present invention.
Figure 8:
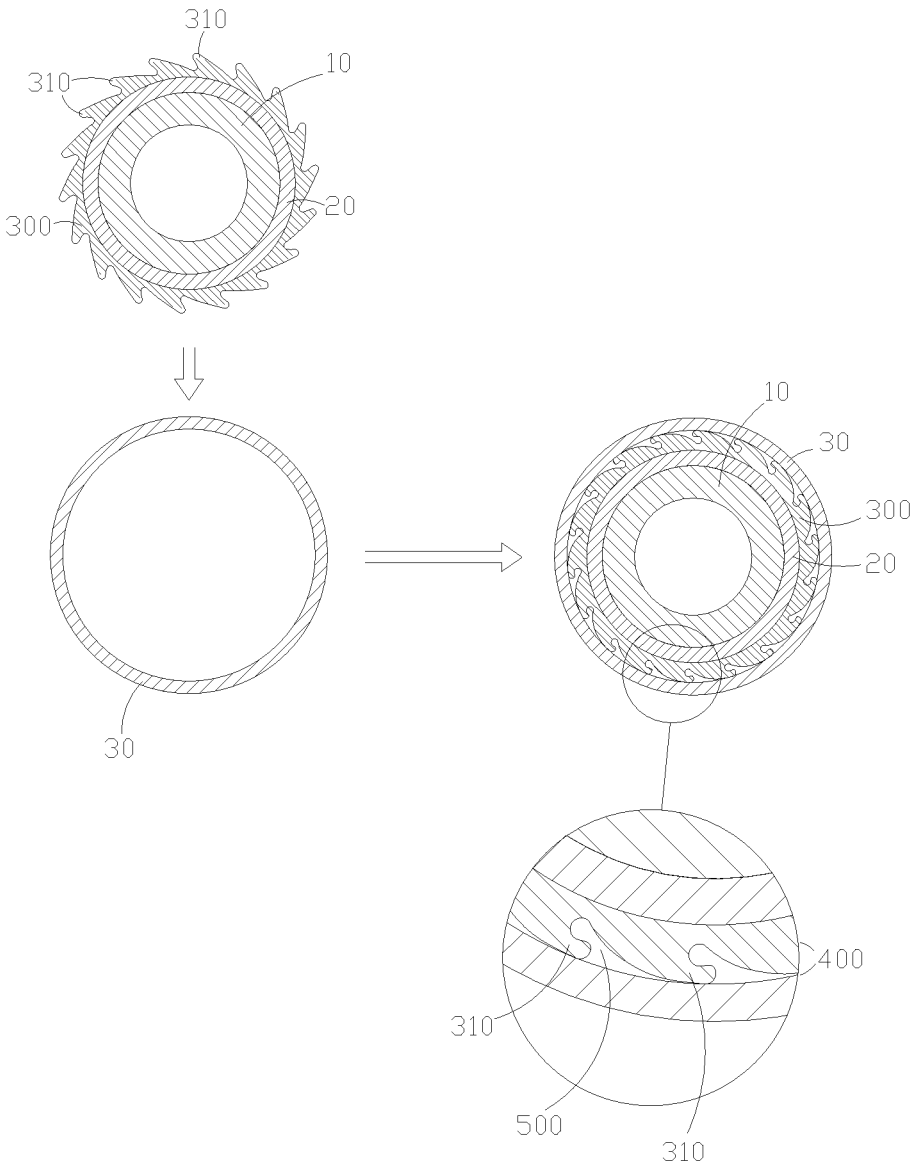
FIG. 8 is a schematic diagram of the damping sleeve, the shaft sleeve and the moving shaft assembled in the massage gun body of the present invention.

As shown in FIGS. 7 and 8, the massage gun body (30) is provided with an assembly cavity (31), wherein the damping sleeve (300) is sleeved on the outer surface of the shaft sleeve (20), and at the same time, the damping sleeve (300) is assembled in the assembly cavity (31).

The damping sleeve (300) is provided with a plurality of convex ribs (310), wherein the convex ribs (310) are located between the damping sleeve (300) and the assembly cavity (31), the damping sleeve (300) is set up in the assembly cavity (31) through the convex ribs (310), and a self-adjusting clearance cavity (400) is formed between the damping sleeve (300) and the assembly cavity (31).

The size of the self-adjusting clearance cavity (400) is determined by the convex ribs (310).

In the specific implementation, the convex ribs (310) evenly are held in the assembly cavity (31). In the prior art, the damping sleeve and the assembly cavity are have a surface contact therebetween, and no assembly clearance is reserved, so the damping sleeve is easily squeezed and deformed, so that the shaft sleeve deviates from the axis.

The present invention is able to form the self-adjusting clearance cavity (400) through the structure of the convex ribs (310) to define an assembly margin and a vibration adjustment margin and make the central axis of the shaft sleeve (20) and the central axis of the assembly cavity (31) coincide with each other as much as possible, so as to ensure the stability of the product during operation, and reducing the working noise.

In the specific implementation, the convex ribs (310) may have various shapes, such as, convex ribs having a trapezoid, triangle, rectangle, etc. cross-section.

In the specific implementation, the outer diameter of the damping sleeve (300) is larger than the inner diameter of the assembly cavity (31).

When the damping sleeve (300) is assembled in the assembly cavity (31), the convex ribs (310) are physically deformed to make the convex ribs (310) being held in the assembly cavity (31).

In the specific implementation, every two adjacent convex ribs (310) define an adjustment cavity (500) therebetween.

When the damping sleeve (300) is assembled in the assembly cavity (31), the convex ribs (310) deform and enter into the adjustment cavity (500), and the size of the adjustment cavity (500) is reduced.

Figure 9:
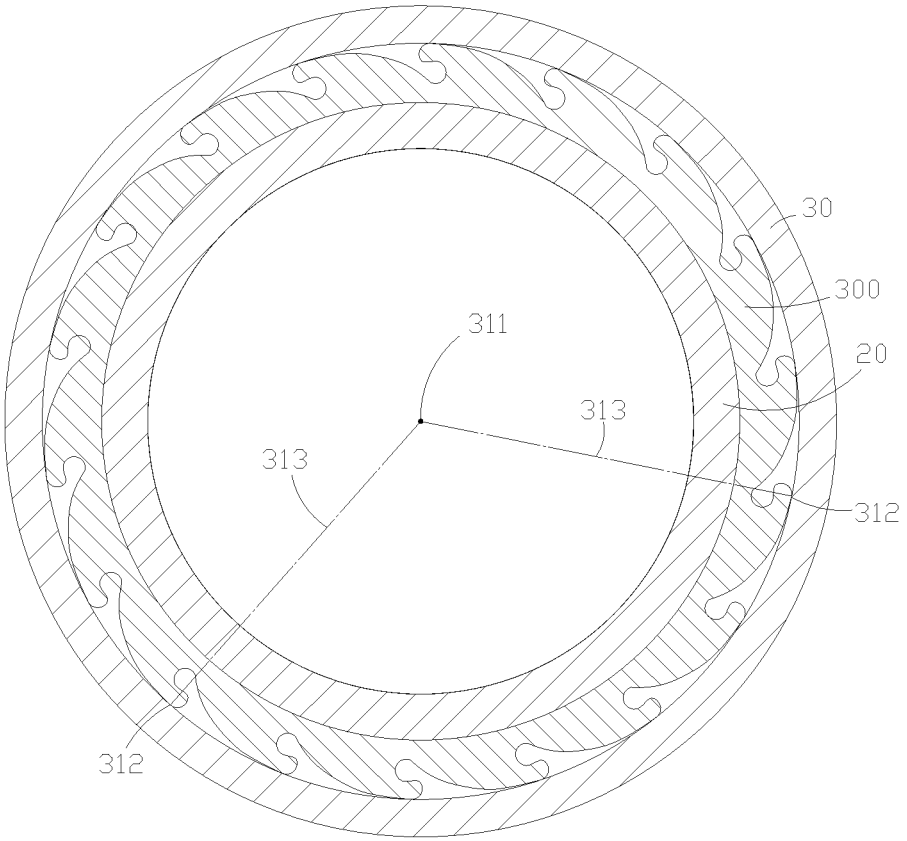
FIG. 9 is a schematic diagram of the convex ribs of the damping sleeve abutting in the assembly cavity of the present invention.

As shown in FIG. 9, in the specific implementation, the damping sleeve (300) has a central axis (311), and each of the convex ribs (310) is held in the assembly cavity (31) to form a contact surface (312) therebetween, and the vertical distances (313) between the central axis (311) and the contact surface (312) are equal.

In practice, when the damping sleeve (300) is just assembled in the assembly cavity (31), the vertical distances (313) are not equal, wherein the elastic restoring force of the convex rib (310) corresponding to the shorter vertical distance (313) is inevitably greater, and the elastic restoring force of the convex rib (310) corresponding to the longer vertical distance (313) is inevitably smaller.

Along with the work of the product and the effect of the vibrating force of the shaft sleeve (20), the vertical distances (313) will tend to be equal, so to make the central axis of the shaft sleeve (20) and the central axis of the assembly cavity (31) tend to coincide and achieve the effect of self-adjusting clearance.

As shown in FIGS. 8 and 9, it is a preferred embodiment of the convex ribs (310) of the present invention.

All of the convex ribs (310) are inclined convex ribs, and the convex ribs (310) rotate and incline in the same direction around the outer surface of the damping sleeve (300). In practice, the convex ribs (310) may inclinedly rotate clockwise or counterclockwise at the same time.

The above structure is able to facilitate the rotational assembly of the damping sleeve (300) into the assembly cavity (31), which makes the assembly process faster and lighter. In the prior art, the damping sleeve and the assembly cavity are in surface contact, which is not conducive to assembly.

As shown in FIGS. 10 to 15, the anti-vibration and wear-resistant massage gun further comprises a moving shaft (10) and a friction protection body (100).

Figure 10:
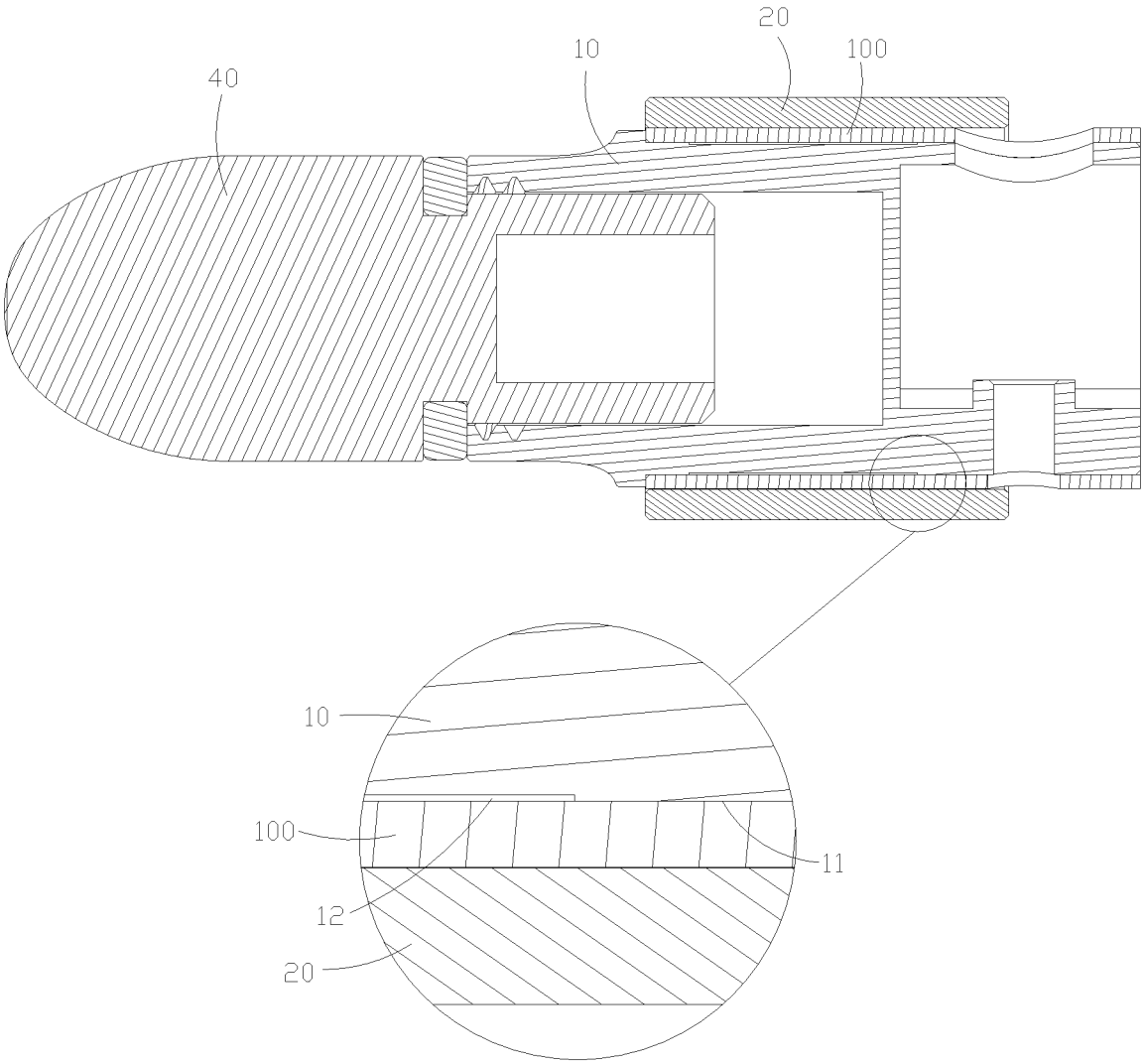
FIG. 10 is a structural diagram of the structure of the moving shaft and the shaft sleeve of the present invention.
Figure 11:
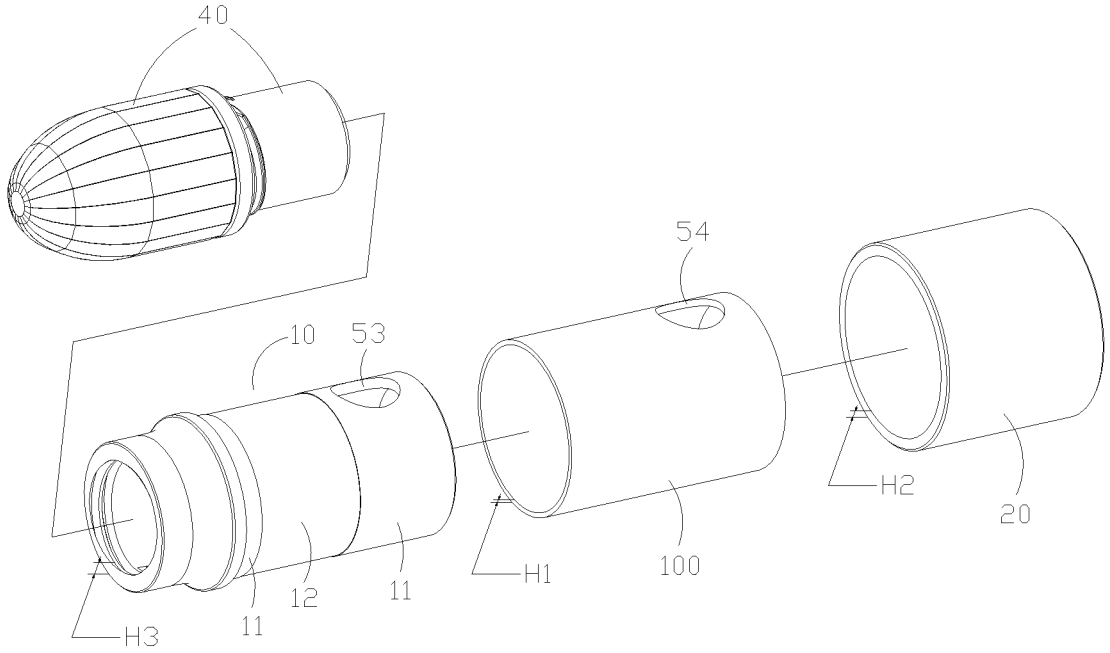
FIG. 11 is a perspective diagram of the moving shaft, the shaft sleeve and the friction protection body of the present invention.

Wherein, as shown in FIGS. 6, 10 and 11, the shaft sleeve (20) is fixedly disposed in the massage gun body (30).

The moving shaft (10) is disposed in the shaft sleeve (20), and the moving shaft (10) is able to reciprocate back and forth in the shaft sleeve (20). A massage head (40) is detachably disposed on the front end of the moving shaft (10).

The moving shaft (10) is connected to the output shaft of a motor (60) through a connecting rod (50).

When working, the motor (60) works, and the moving shaft (10) is driven through the connecting rod (50) to perform high-speed forward and backward reciprocating motion in the shaft sleeve (20). At this moment, the moving shaft (10) drives the massage head (40) to move, and the massage head (40) hits the human muscles to perform massage actions.

The friction protection body (100) is covered on the moving shaft (10), and at the same time, the friction protection body (100) is located between the moving shaft (10) and the shaft sleeve (20).

When the moving shaft (10) reciprocates back and forth in the shaft sleeve (20), the friction protection body (100) moves synchronously with the moving shaft (10), at this time, frictional force is generated between the friction protection body (100) and the shaft sleeve (20), and the moving shaft (10) is not in contact with the shaft sleeve (20).

The material hardness of the friction protection body (100) is greater than the material hardness of the shaft sleeve (20).

In the specific implementation, the material hardness of the friction protection body (100) is greater than the material hardness of the shaft sleeve (20), and the material hardness of the shaft sleeve (20) is greater than the material hardness of the moving shaft (10).

In the specific implementation, the friction protection body (100), all the moving shaft (10) and the shaft sleeve (20) are made of metal material, wherein the friction protection body (100) is made of stainless steel, the moving shaft (10) is made of aluminum, and the shaft sleeve (20) is made of copper.

In practice, since the friction protection body (100) has a relatively high hardness, the outer surface of the friction protection body (100) and the inner surface of shaft sleeve (20) may adopt a smooth design to reduce the friction force.

As shown in FIG. 11, in the specific implementation, all the friction protection body (100), the moving shaft (10) and the shaft sleeve (20) are tubular.

The tube wall thickness (H1) of the friction protection body (100) is smaller than the tube wall thickness (H2) of the shaft sleeve (20), and the tube wall thickness (H1) of the friction protection body (100) is smaller than the tube wall thickness (H3) of the moving shaft (10).

In practice, the tube wall thickness (H1) of the friction protection body (100) of the present invention is much smaller than the tube wall thickness (H2) of the shaft sleeve (20) and the tube wall thickness (H3) of the moving shaft (10).

Firstly, this design can greatly reduce the material cost of the friction protection body (100).

Secondly, the friction protection body (100) with a thinner tube wall has a smaller thermal expansion and contraction value, which can avoid the occurrence of the situation that the moving shaft (10) gets stuck in the shaft sleeve (20) after thermal expansion.

In the specific implementation, the tube wall thickness (H1) of the friction protection body (100) is less than 1 mm.

In the specific implementation, in order to reduce the friction force between the friction protection body (100) and the shaft sleeve (20), the shaft sleeve (20) is a self-lubricating shaft sleeve, wherein a lubricating oil film is formed between the friction protection body (100) and the shaft sleeve (20), and the self-lubricating shaft sleeve is the prior art, which will not be redundantly described here.

As mentioned above, the present invention adopts the friction protection body (100) with thin tube wall and hard material, which can firstly avoid the wear of the moving shaft (10), and secondly, can reduce the thermal expansion and contraction value of the friction protection body (100), and avoid the occurrence of the situation that the moving shaft (10) gets stuck in the shaft sleeve (20) after thermal expansion.

Figure 12:
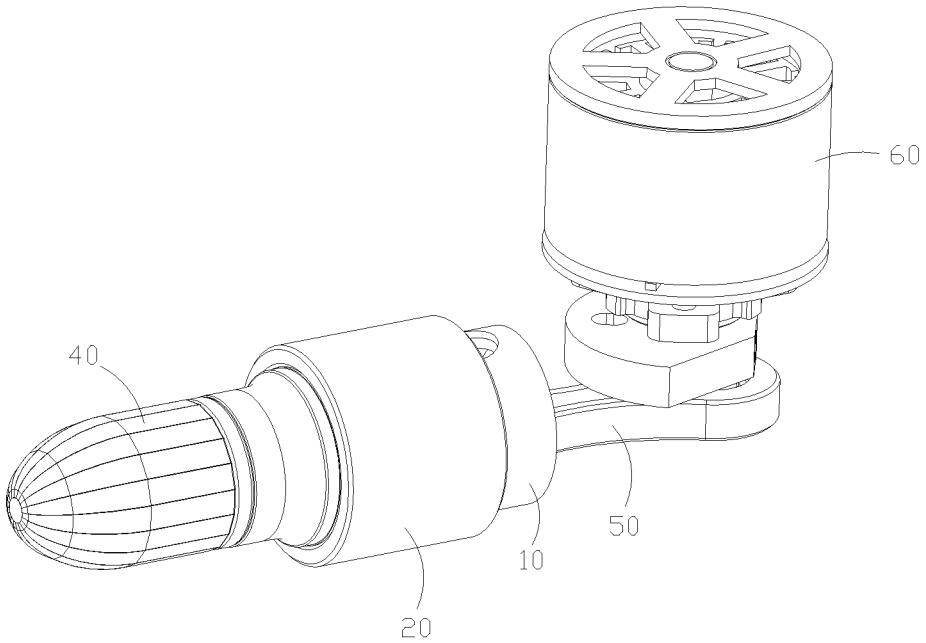
FIG. 12 is a perspective diagram of the connecting rod and the motor of the present invention.
Figure 13:
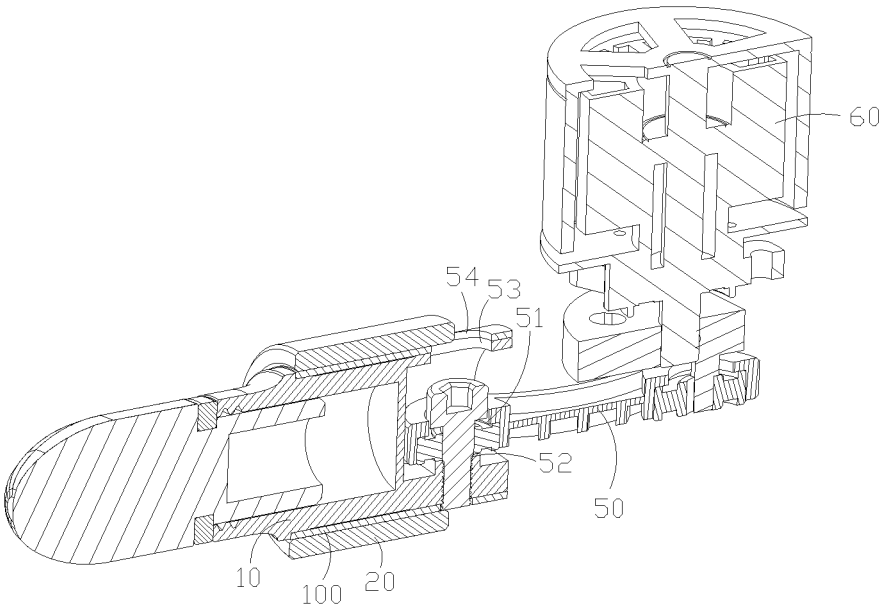
FIG. 13 is a sectional diagram of the structure of the connecting rod and the motor of the present invention.

As shown in FIGS. 12 and 13, in the specific implementation, one end of the connecting rod (50) is connected to the output shaft of the motor (60), and the other end of the connecting rod (50) is inserted into and connected to the moving shaft (10). This structure can greatly shorten the transmission length of the massage gun, and make the product miniaturized.

In practice, the end portion of the connecting rod (50) is provided with a connecting hole (51).

A connecting platform is disposed in the inner cavity of the moving shaft (10), and the connecting platform is provided with a fixing hole (52).

A connecting bolt is inserted in the connecting hole (51) and the fixing hole (52), so that the connecting rod (50) can be inserted into and connected to the moving shaft (10).

The moving shaft (10) is provided with a first tool hole (53) corresponding to the connecting hole (51), and the friction protection body (100) is provided with a second tool hole (54). Through the first tool hole (53) and the second tool hole (54), it is convenient for users to insert a tool from top to rotate the connecting bolt.

As shown in FIG. 10, in the specific implementation, the outer surface of the moving shaft (10) is provided with contact assembly surfaces (11) and a non-contact avoidance area (12), wherein the friction protection body (100) is sleeved on the contact assembly surface (11), the inner surface of the friction protection body (100) is pressed on the contact assembly surface (11), and the inner surface of the friction protection body (100) is not in contact with the non-contact avoidance area (12).

The structural design mentioned above can greatly reduce the contact area between the friction protection body (100) and the moving shaft (10), thereby facilitating assembly, and improving assembly accuracy.

In the specific implementation, the contact assembly surfaces (11) are disposed on two end portions of the moving shaft (10), and the non-contact avoidance area (12) is located between the two contact assembly surfaces (11).

Figure 14:
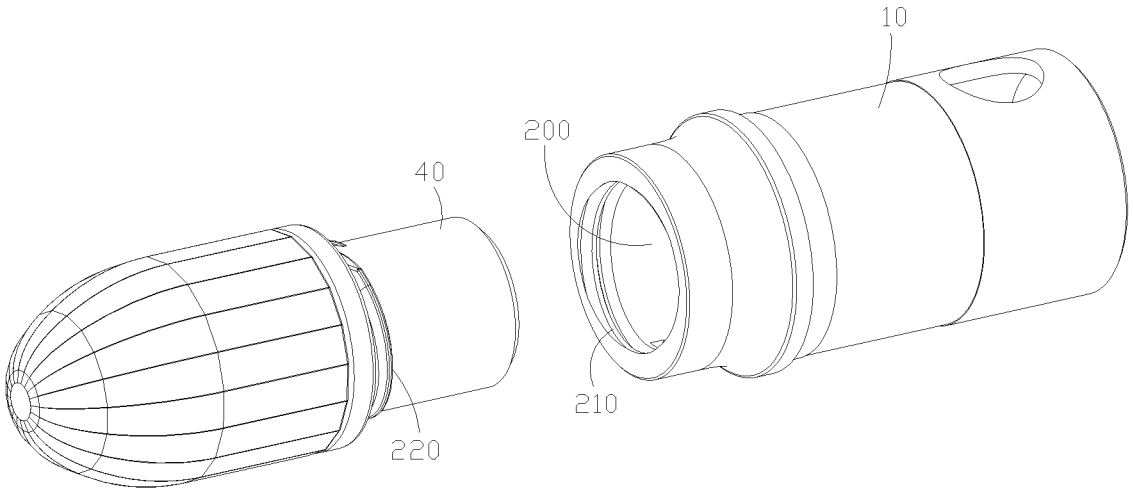
FIG. 14 is a perspective diagram of the assembly mechanism and the assembly groove of the present invention.
Figure 15:
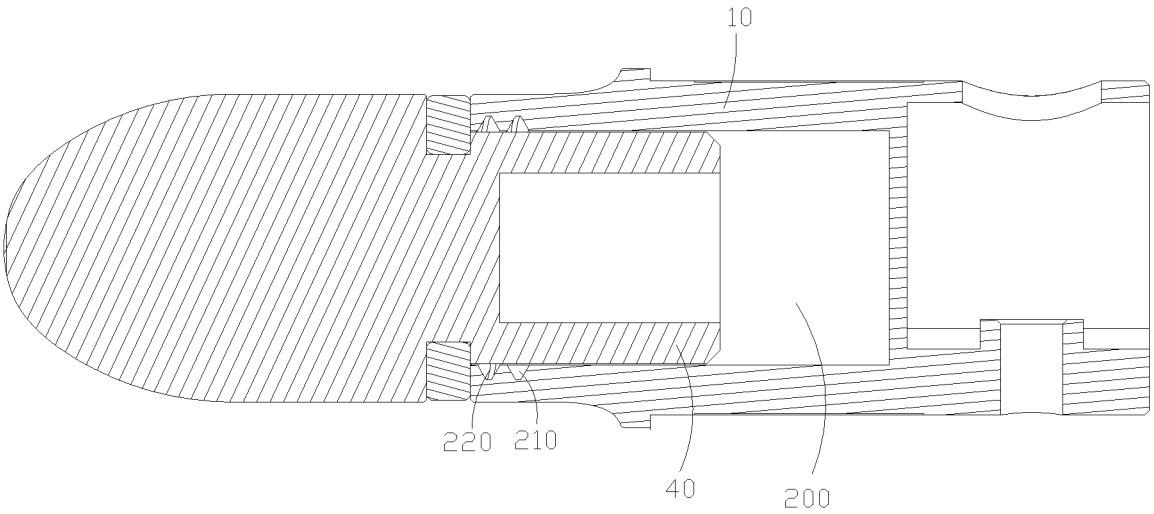
FIG. 15 is a sectional diagram of the assembly mechanism and the assembly groove of the present invention.

As shown in FIGS. 14 and 15, in the specific implementation, the front end of the moving shaft (10) is provided with a massage head assembly hole (200), and the massage head (40) is detachably assembled in the massage head assembly hole (200).

The inner side surface of the massage head assembly hole (200) is provided with a assembly groove (210), and the massage head (40) is provided with a assembly mechanism (220) corresponding to the assembly groove (210), wherein the assembly mechanism (220) is fixed in the assembly groove (210), to assemble the massage head (40) in the massage head assembly hole (200).

In the traditional massage gun, if the inner side surface of the massage head assembly hole is slotted, the wall thickness of the moving shaft will inevitably be reduced, thereby greatly reducing the structural strength of the moving shaft.

In the present invention, since the existence of the friction protection body (100), and at the same time, since the hardness and structural strength of the friction protection body (100) are higher than the moving shaft (10), making the assembly groove (210) not reduce the structural strength of the portion of the moving shaft.

In practice, the massage head (40) is able to coincide with the axis of the moving shaft (10) through the assembly mechanism (220) and the structure of the assembly groove (210), thereby improving the assembly accuracy, and facilitating disassembly.

A preferred embodiment of the present invention is that the massage head (40) is rotatably assembled in the massage head assembly hole (200), wherein the assembly mechanism (220) is an external thread, the assembly groove (210) is an internal thread, and the assembly mechanism (220) is screwed in the assembly groove (210).

What is claimed is:

1. An anti-vibration and wear-resistant massage gun, comprising:

an adaptive buffer damping sleeve (300), wherein said damping sleeve (300) is disposed between a shaft sleeve (20) and a massage gun body (30), and said damping sleeve (300) is used for alleviating a vibration generated by said shaft sleeve (20) to ensure that the vibration of said shaft sleeve (20) is not directly transmitted to said massage gun body (30), wherein said massage gun body (30) is provided with an assembly cavity (31), said damping sleeve (300) is sleeved on the outer surface of said shaft sleeve (20), and simultaneously, said damping sleeve (300) is assembled in said assembly cavity (31), wherein said damping sleeve (300) is provided with a plurality of convex ribs (310), said convex ribs (310) are located between said damping sleeve (300) and said assembly cavity (31), said damping sleeve (300) is set up in said assembly cavity (31) through said convex ribs (310), and a self-adjusting clearance cavity (400) is formed between said damping sleeve (300) and said assembly cavity (31), and wherein said anti-vibration and wear-resistant massage gun further comprises a moving shaft (10) and a friction protection body (100), wherein said moving shaft (10) is disposed in said shaft sleeve (20), said moving shaft (10) is capable of reciprocating back and forth in said shaft sleeve (20), and a massage head (40) is detachably disposed on a front end of said moving shaft (10), wherein said friction protection body (100) covers said moving shaft (10), and simultaneously, said friction protection body (100) is located between said moving shaft (10) and said shaft sleeve (20), and when said moving shaft (10) reciprocates back and forth in said shaft sleeve (20), said friction protection body (100) moves synchronously with said moving shaft (10), at this time, frictional force is generated between said friction protection body (100) and said shaft sleeve (20), and said moving shaft (10) is not in contact with said shaft sleeve (20), wherein the material hardness of said friction protection body (100) is greater than the material hardness of said shaft sleeve (20).

2. The anti-vibration and wear-resistant massage gun as recited in claim 1, wherein the outer diameter of said damping sleeve (300) is larger than the inner diameter of said assembly cavity (31), and when said damping sleeve (300) is assembled in said assembly cavity (31), said convex ribs (310) are physically deformed to make said convex ribs (310) be held in said assembly cavity (31).

3. The anti-vibration and wear-resistant massage gun as recited in claim 2, wherein every two adjacent said convex ribs (310) define an adjustment cavity (500) therebetween, and when said damping sleeve (300) is assembled in said assembly cavity (31), said convex ribs (310) deform and enter into said adjustment cavity (500), and the size of said adjustment cavity (500) is reduced.

4. The anti-vibration and wear-resistant massage gun as recited in claim 1, wherein said damping sleeve (300) has a central axis (311), each of said convex ribs (310) abuts against said assembly cavity (31) to form a contact surface (312), and the vertical distance (313) from said central axis (311) to each said contact surface (312) is equal.

5. The anti-vibration and wear-resistant massage gun as recited in claim 1, wherein all said convex ribs (310) are inclined convex ribs, and said convex ribs (310) rotate and incline in the same direction around the outer surface of said damping sleeve (300).

6. The anti-vibration and wear-resistant massage gun as recited in claim 1, wherein the material hardness of said shaft sleeve (20) is greater than the material hardness of said moving shaft (10).

7. The anti-vibration and wear-resistant massage gun as recited in claim 6, wherein said friction protection body (100), said moving shaft (10) and said shaft sleeve (20) are all made of metal materials, wherein, said friction protection body (100) is made of stainless steel, said moving shaft (10) is made of aluminum, and said shaft sleeve (20) is made of copper.

8. The anti-vibration and wear-resistant massage gun as recited in claim 1, wherein a tube wall thickness (H1) of said friction protection body (100) is smaller than a tube wall thickness (H2) of said shaft sleeve (20), and the tube wall thickness (H1) of said friction protection body (100) is smaller than a tube wall thickness (H3) of said moving shaft (10).

9. The anti-vibration and wear-resistant massage gun as recited in claim 8, wherein an outer surface of said moving shaft (10) is provided with contact assembly surfaces (11) and a non-contact avoidance area (12), wherein said friction protection body (100) is sleeved on said contact assembly surface (11), the inner surface of said friction protection body (100) is pressed on said contact assembly surface (11), and the inner surface of said friction protection body (100) is not in contact with said non-contact avoidance area (12).

10. The anti-vibration and wear-resistant massage gun as recited in claim 9, wherein said contact assembly surfaces (11) are disposed on two end portions of said moving shaft (10), and said non-contact avoidance area (12) is located between two said contact assembly surfaces (11).

11. The anti-vibration and wear-resistant massage gun as recited in claim 1, wherein the front end of said moving shaft (10) is provided with a massage head assembly hole (200), and said massage head (40) is detachably assembled in said massage head assembly hole (200), wherein an inner side surface of said massage head assembly hole (200) is provided with a assembly groove (210), said massage head (40) is provided with an assembly mechanism (220) corresponding to said assembly groove (210), and said assembly mechanism (220) is fixed in said assembly groove (210).

12. The anti-vibration and wear-resistant massage gun as recited in claim 11, wherein said massage head (40) is rotatably assembled in said massage head assembly hole (200), said assembly mechanism (220) is an external thread, said assembly groove (210) is an internal thread, and said assembly mechanism (220) is screwed in said assembly groove (210).

13. The anti-vibration and wear-resistant massage gun as recited in claim 1, wherein said moving shaft (10) is connected to an output shaft of a motor (60) through a connecting rod (50), one end of said connecting rod (50) is connected to said output shaft of said motor (60), and a second end of said connecting rod (50) is inserted into and connected to said moving shaft (10).

14. The anti-vibration and wear-resistant massage gun as recited in claim 13, wherein the second end portion of said connecting rod (50) is provided with a connecting hole (51), a connecting platform is disposed in an inner cavity of said moving shaft (10), and said connecting platform is provided with a fixing hole (52), wherein a connecting bolt is inserted in said connecting hole (51) and said fixing hole (52), said moving shaft (10) is provided with a first tool hole (53) corresponding to said connecting hole (51), and said friction protection body (100) is provided with a second tool hole (54).

15. The anti-vibration and wear-resistant massage gun as recited in claim 1, wherein said shaft sleeve (20) is a self-lubricating shaft sleeve, and a lubricating oil film is formed between said friction protection body (100) and said shaft sleeve (20).

16. An anti-vibration and wear-resistant massage gun, comprising: a moving shaft (10); a shaft sleeve (20); and a friction protection body (100), wherein said shaft sleeve (20) is fixedly disposed in a massage gun body (30), said moving shaft (10) is disposed in said shaft sleeve (20), said moving shaft (10) is able to reciprocate back and forth in said shaft sleeve (20), a massage head (40) is detachably disposed on a front end of said moving shaft (10), said friction protection body (100) is covered on said moving shaft (10), and simultaneously, said friction protection body (100) is located between said moving shaft (10) and said shaft sleeve (20), and when said moving shaft (10) reciprocates back and forth in said shaft sleeve (20), said friction protection body (100) moves synchronously with said moving shaft (10), at this time, frictional force is generated between said friction protection body (100) and said shaft sleeve (20), said moving shaft (10) is not in contact with said shaft sleeve (20), a material hardness of said friction protection body (100) is greater than a material hardness of said shaft sleeve (20), a tube wall thickness (H1) of said friction protection body (100) is smaller than a tube wall thickness (H2) of said shaft sleeve (20), the tube wall thickness (H1) of said friction protection body (100) is smaller than a tube wall thickness (H3) of said moving shaft (10).

17. The anti-vibration and wear-resistant massage gun as recited in claim 16, wherein an outer surface of said moving shaft (10) is provided with contact assembly surfaces (11) and a non-contact avoidance area (12), wherein said friction protection body (100) is sleeved on said contact assembly surface (11), an inner surface of said friction protection body (100) is pressed on said contact assembly surface (11), and the inner surface of said friction protection body (100) is not in contact with said non-contact avoidance area (12).

18. The anti-vibration and wear-resistant massage gun as recited in claim 16, wherein the front end of said moving shaft (10) is provided with a massage head assembly hole (200), an inner side surface of said massage head assembly hole (200) is provided with an assembly groove (210), said massage head (40) is provided with an assembly mechanism (220) corresponding to said assembly groove (210), and said assembly mechanism (220) is fixed in said assembly groove (210).

19. The anti-vibration and wear-resistant massage gun as recited in claim 18, wherein said massage head (40) is rotatably assembled in said massage head assembly hole (200), said assembly mechanism (220) is an external thread, said assembly groove (210) is an internal thread, and said assembly mechanism (220) is screwed in said assembly groove (210).

20. The anti-vibration and wear-resistant massage gun as recited in claim 16, wherein said moving shaft (10) is connected to an output shaft of a motor (60) through a connecting rod (50), one end of said connecting rod (50) is connected to said output shaft of said motor (60), and a second end of said connecting rod (50) is inserted into and connected to said moving shaft (10).

21. The anti-vibration and wear-resistant massage gun as recited in claim 20, wherein the second end portion of said connecting rod (50) is provided with a connecting hole (51), a connecting platform is disposed in an inner cavity of said moving shaft (10), said connecting platform is provided with a fixing hole (52), a connecting bolt is inserted in said connecting hole (51) and said fixing hole (52), said moving shaft (10) is provided with a first tool hole (53) corresponding to said connecting hole (51), and said friction protection body (100) is provided with a second tool hole (54).

* * * * *